US005183155A

United States Patent [19]

Vavra

[11] Patent Number: 5,183,155

[45] Date of Patent: Feb. 2, 1993

[54] PACKAGING SYSTEM FOR A TOILET WATER TANK AND COVER

[76] Inventor: Paul P. Vavra, 519 Pine Tree Rd., Kohler, Wis. 53044

[21] Appl. No.: 630,526

[22] Filed: Dec. 20, 1990

[51] Int. Cl.[5] ..... B65D 85/00

[52] U.S. Cl. ..... 206/320; 206/525; 206/586; 206/593

[58] Field of Search ..... 206/320, 321, 523, 586, 206/591, 592, 594, 593; 229/87.02, 87.01, 40, 198.5

[56] References Cited

U.S. PATENT DOCUMENTS

| | | | |
|---|---|---|---|
| 2,163,045 | 4/1939 | Lavere . | |
| 2,314,491 | 7/1943 | Greenberg . | |
| 2,397,041 | 12/1946 | Pantalone . | |
| 2,509,447 | 7/1950 | Prawczik . | |
| 2,570,946 | 3/1951 | Hennessey . | |
| 2,969,170 | 1/1961 | Waldorf | 206/320 |
| 3,084,479 | 8/1963 | Vander Lugt, Jr. . | |
| 3,113,667 | 12/1963 | Knapp et al. | 206/593 |
| 3,232,513 | 12/1966 | Maio . | |
| 3,271,357 | 12/1966 | Burt . | |
| 3,289,825 | 12/1966 | Smith | 206/320 |
| 3,361,330 | 1/1968 | Arneson . | |
| 3,380,644 | 3/1968 | D'Alessio . | |
| 3,471,116 | 10/1969 | DeCherrie | 206/320 |
| 3,481,453 | 4/1969 | Shreve, III et al. . | |
| 3,487,914 | 1/1970 | Weaver | 206/320 |
| 3,521,812 | 11/1970 | Moers et al. . | |
| 3,664,494 | 11/1972 | Mergens . | |
| 3,693,866 | 11/1972 | Struble . | |
| 3,705,681 | 7/1972 | Rossi et al. . | |
| 3,773,171 | 11/1973 | Edsall | 206/320 |
| 3,820,708 | 1/1974 | Sieffert . | |
| 3,836,066 | 6/1974 | Del Priore et al. . | |
| 3,871,572 | 9/1975 | Skaggs . | |
| 3,900,101 | 8/1975 | Goodsite | 206/320 |
| 3,964,669 | 4/1976 | Sontag et al. . | |
| 4,019,672 | 1/1977 | Giannini . | |
| 4,071,140 | 12/1978 | Rattner . | |
| 4,375,261 | 1/1983 | Kitchell . | |
| 4,493,453 | 7/1985 | LeDrew . | |
| 4,574,998 | 5/1986 | Vavra . | |
| 4,579,226 | 4/1986 | Blake et al. | 206/593 |
| 4,674,633 | 4/1987 | Steadman . | |
| 4,718,545 | 8/1988 | Chranowski et al. . | |
| 4,773,539 | 4/1988 | Nock . | |
| 4,798,291 | 3/1989 | Carver . | |
| 4,821,884 | 10/1989 | Griffin et al. . | |
| 4,836,364 | 3/1989 | Hanko et al. . | |
| 4,848,541 | 7/1989 | Paliotta et al. . | |
| 4,895,295 | 4/1990 | Montgomery et al. . | |
| 4,901,849 | 11/1990 | Wilson . | |
| 4,905,820 | 6/1990 | Hart et al. . | |
| 4,925,088 | 1/1990 | Ostrander . | |

FOREIGN PATENT DOCUMENTS

| | | |
|---|---|---|
| 2636454 | 3/1978 | Fed. Rep. of Germany . |
| 307537 | 7/1969 | Sweden . |

*Primary Examiner*—Paul T. Sewell
*Assistant Examiner*—Thomas P. Hilliard
*Attorney, Agent, or Firm*—Andrus, Sceales, Starke & Sawall

[57] ABSTRACT

An open-ended shipping container with locating, separator and riser pads and a container blank for forming such a container is disclosed. The container is especially suitable for packaging fragile and heavy articles such as toilet tanks and water containers, with or without covers and extended appendages for filling and drainage and with or without surface mounted control levers, in a single package.

3 Claims, 5 Drawing Sheets

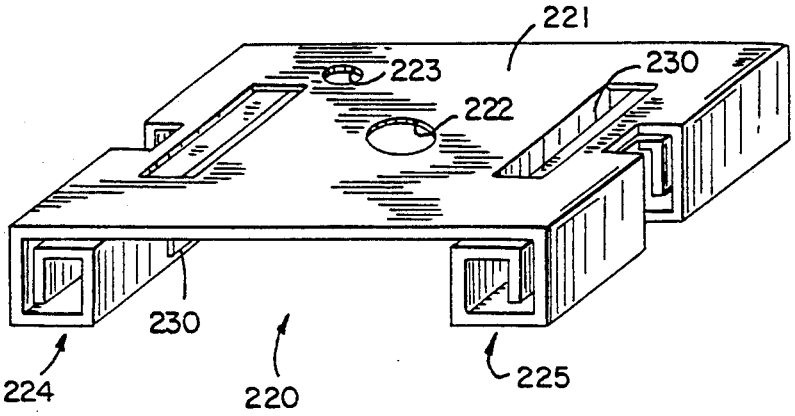
FIG. 13
FIG. 14
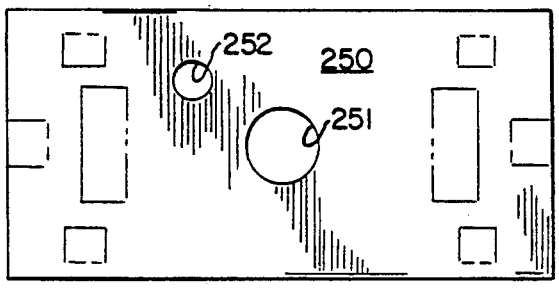
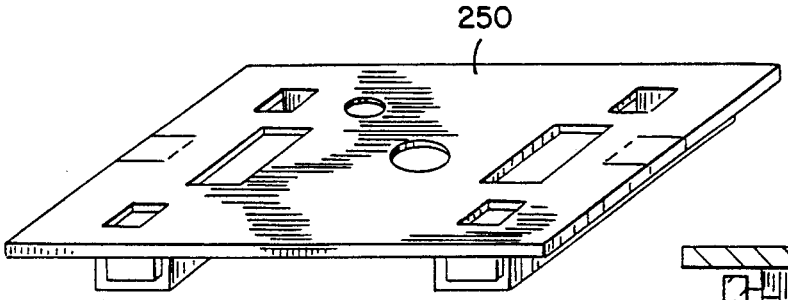
FIG. 15
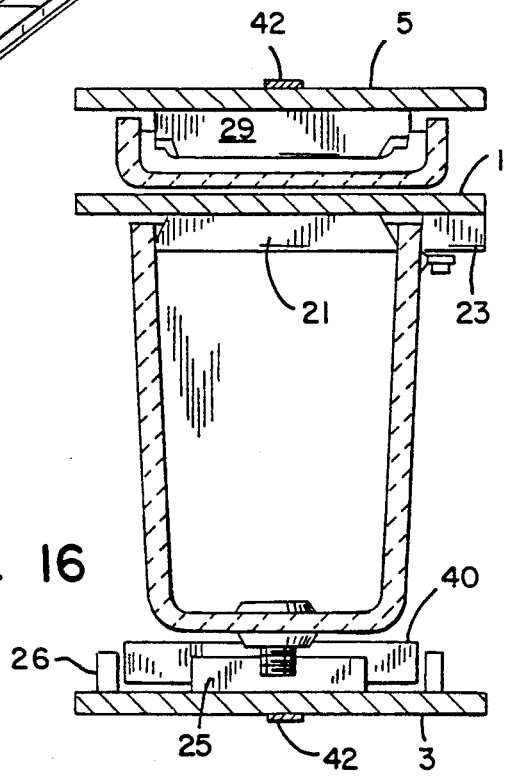
FIG. 16

PACKAGING SYSTEM FOR A TOILET WATER TANK AND COVER

BACKGROUND OF THE INVENTION

1. Scope of the Invention

This invention relates to an open-ended shipping container for articles such as or similar to a toilet water tank with or without a cover. It also relates to a container blank for forming such a container.

2. Description of the Science

The combination of design, fragility and weight of articles such as toilet tanks and water containers with covers results in certain shipping and packaging material waste disposal problems. One problem is that because most prior containers for such articles were fully enclosed, weight is at times mistakenly equated with ruggedness, so that a heavy container would on occasion be mishandled. Verbal and pictorial warnings strategically located on the container are often not believed or simply ignored.

Another problem is that because of the nature of the enclosed container, little discouragement is given to careless handlers in assessing responsibility for damage. In most cases, the damage is not apparent until the container is opened.

Another problem is that the cover of the tank is usually wider than the body of the tanks, thus requiring fillers or spacers along article surfaces so as to prevent the article from tilting and sliding within the container.

Another concern is that of waste disposal. A container should use the minimal amount of materials, which are preferably recyclable.

Another concern is that of energy conservation. A container's design should allow for minimal use of energy in its manufacture and in material storage areas, both in warehouse and production areas.

It can therefore, be seen that a need exists for a more efficient container for articles such as toilet tanks and water containers with or without covers and/or extended filler and drain pipes and surface mounted control valves.

The present invention has as its object to address the concerns noted above. More specifically, it is a principal object of the invention to provide an open-ended container with an integral centering article cover, and body panels or individual riser and/or body/cover separator pads for securely holding an enclosed article in place.

It is another object of the invention to provide a shipping container which:

1. conserves packaging material;
2. conserves energy in its manufacturing, assembly, storage and shipping;
3. is easily manufactured and constructed into a shipping container;
4. reduces waste disposal and handling;
5. is made of materials which are readily recyclable;
6. reveals its contents and any damage to prospective handlers.

SUMMARY OF THE INVENTION

The invention comprises an open-ended shipping container (FIG. 5) and a container blank (FIG. 1) for forming such a container, and one or more article body riser pads for stabilizing the article body within the container because of the filler and drain pipes which normally extend through the article bottom. The blank (FIG. 1) consists of a number of panels which have cut, hinged and creased flaps and tabs which are used to restrain and locate the article cover, body and body riser pads. Tabs and flaps in both ends of the bottom panel are pushed upward to receive and hold riser pads. The article body bottom sets on these two riser pads which raise the tank body to allow for an air space between the bottom panel and the ends of any extended appendages beyond the article body bottom surface, such as filler and drain pipes. The blank is folded so that an article body/cover separator panel extends across and beyond the outside edges of the article first and second sides and both ends. A partial first side panel which is connected to the body/cover separator panel adjacent a side edge of the body/cover separator panel extends across and beyond the first article side. A bottom panel is connected to the partial first side panel adjacent a bottom edge of the partial first side panel and extends across and beyond the article bottom and the two riser blocks. A second side panel is connected to the bottom panel adjacent a side edge of the bottom panel opposite the first side panel, and extends across and beyond the article body and cover sides opposite the article first side. A top panel is connected to the second side panel adjacent a top edge of the second side panel and extends across and beyond the article cover from the second side top edge to and above the first side top edge. A partial top first side panel is connected to the top panel adjacent a top edge of the top panel, and extends across and beyond the article cover first side which is opposite the article cover second side. A set of holding and locking tabs are connected to the partial top first side panel adjacent its top edge and extend across and through body/cover separator panel slots and along the inside surface of the body section of the first side panel. The open-ended nature of the container so formed allows for visual inspection of the article, which is located inward of the edges of the container blank ends, bottom risers and body/cover separator panel.

In another variation (FIG. 9), there is provided a blank (FIG. 7), two "tray-end" separator pads, and two "tray-end" riser pads. The two riser pads are located on the two ends of a blank bottom panel. The article body bottom is located within the two tray-end riser pads. The two tray-end body/cover separator pads are located over the two top ends of the article body. The article cover is located within the two tray-end body/cover separator pads. The blank is folded so that a first article top panel is located over and extends across the article cover and body/cover separator tray-end pads. A first side panel is connected to the first top panel adjacent a side edge of the first top panel and extends across a first side of the article cover, the body/cover separator tray-end pads, the article body and the body riser tray-end pads. A bottom panel is connected to the first side panel adjacent a bottom edge of the first side panel and extends across the article bottom and article body riser tray-end pads. A second side panel, which is connected to the bottom panel adjacent a side edge of the bottom panel which is opposite the first side panel, extends across a second side of the article body riser tray-end pads, article body, body/cover separator tray-end pads and article cover. A second top panel is connected to the second side panel adjacent a top edge of the second side panel and extends across and over the first top panel from the second side panel top edge to the first side panel top edge. The open-ended nature of the container so formed allows for visual inspection of the article, which is located inward of the edges of the blank ends, riser and body/cover separator tray-end pads.

The present invention provides a savings in packaging materials by eliminating the need for end walls and article shipping spacers. The rectangular shaped blank reduces waste material in fabrication from raw sheet stock. The resultant open-ended shipping container reveals the article and its condition before and after each particular handling and shipping operation. This gives notice that it should be handled carefully, and reveals any damage that might occur during the handling and shipping operations. Responsibility for breakage is therefore much easier to assess, thereby reducing article damage.

Many variations of the design summarized above can be employed to accommodate articles of varying weights and designs.

The foregoing and other objects and advantages of the invention will appear in the following detailed description. In the description, reference is made to the accompanying drawings which show by way of illustration and not limitation a preferred embodiment of the invention.

BRIEF DESCRIPTION OF THE DRAWINGS

The drawings illustrate the best mode presently contemplated of carrying out the invention.

In the drawings:

FIG. 13 is an isometric view of the folded blank of FIG. 12 above.

FIG. 14 is a top plan view of a blank which can be used as an alternate to form the article body riser pads, the pads being shown in FIGS. 2, 8 and 13.

FIG. 15 is an isometric view of an assembly consisting of the formed blank of FIG. 14 and the riser pads as shown in FIGS. 2 and 3.

FIG. 16 is a cross-sectional view of an alternate form of a shipping container with side panels removed so as to form a shipping container which exposes the total article to all handlers and shippers.

DETAILED DESCRIPTION OF THE PREFERRED EMBODIMENTS

Figure 1:
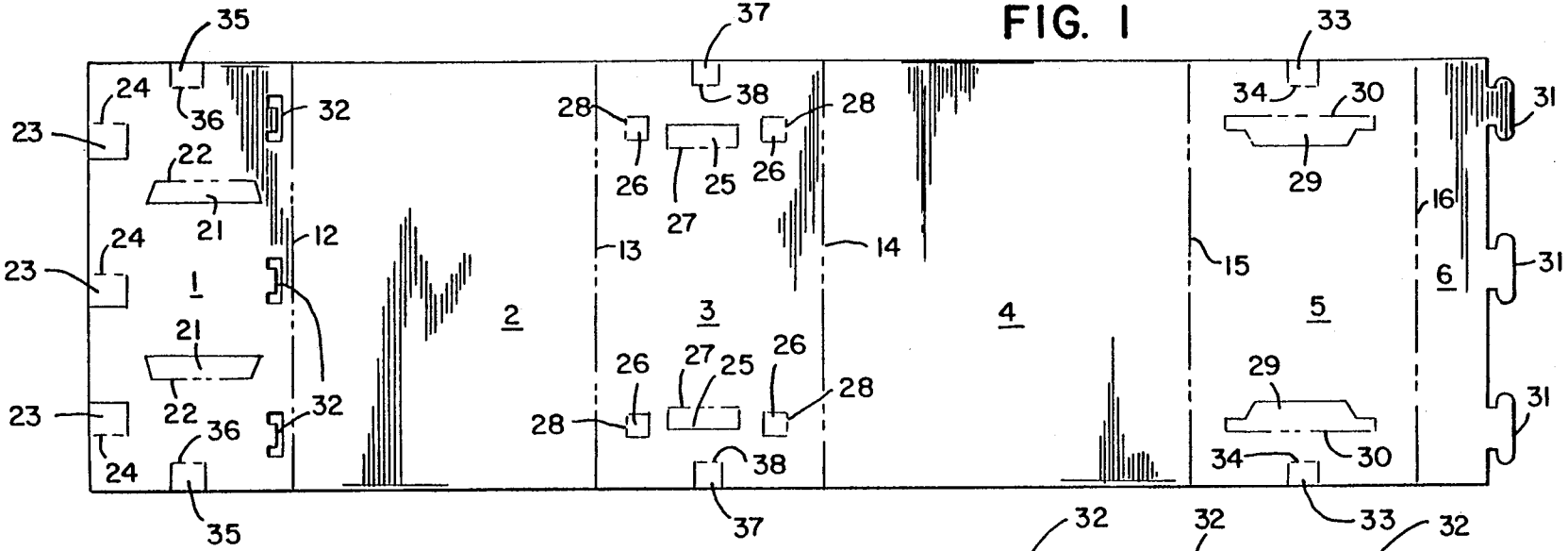
FIG. 1 is a top plan view of an unfolded blank for forming an open-ended container according to the invention.
Figure 3:
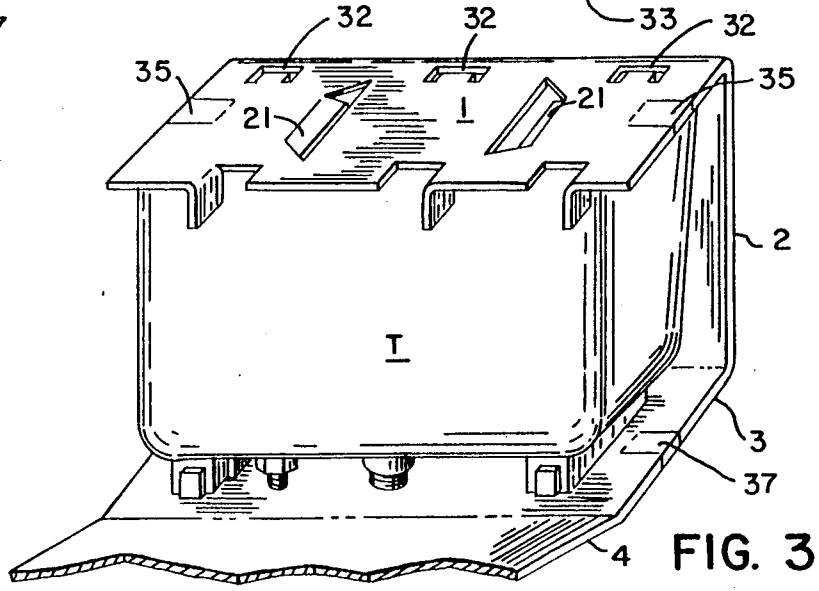
FIG. 3 is a partial perspective view of the blank of FIG. 1 and two riser pads, with the article body in position and the first blank top panel located in position over the article body top for centering and locating the article body in position.

In the drawing figures, creased or bend lines are indicated by broken (dashed) lines and cut lines are indicated by solid lines.

Referring to the drawing figures, the shipping container of FIGS. 5, 6, 9 and 16 is shown in various stages and material design combinations of being wrapped around a two-piece article. While the invention is especially adapted for two piece, heavy and fragile articles such as toilet tanks and water containers with covers, it could of course be used for any article and number of article pieces of varying design, materials, shapes, sizes and weights. The embodiment shown in FIGS. 1 through 6 consists of a six panel blank (FIG. 1) and one (of many) style of article body support/riser pad (shown in FIG. 2). This embodiment illustrates that the quantity of packaging component parts can be reduced to a minimum and still properly protect and restrain the article in the normal handling and shipping environment for products such as toilet tanks and water containers with covers, extended water control valves, filler and drain pipes.

Figure 2:
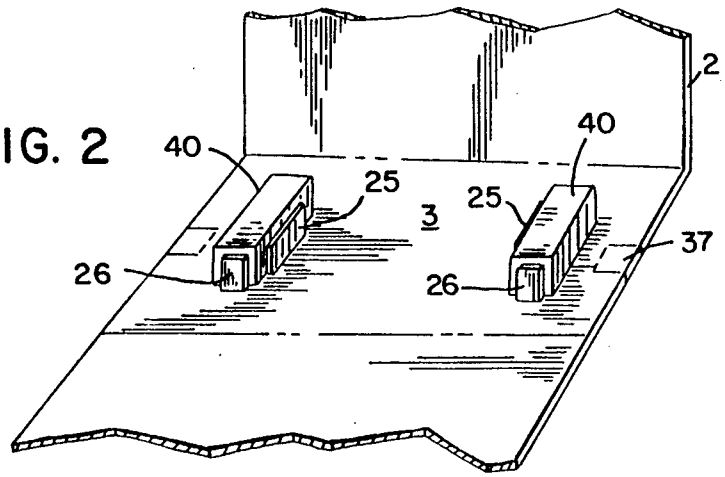
FIG. 2 is a perspective view of the blank of FIG. 1 with two riser pads in position for locating the article body to be packed.
Figure 4:
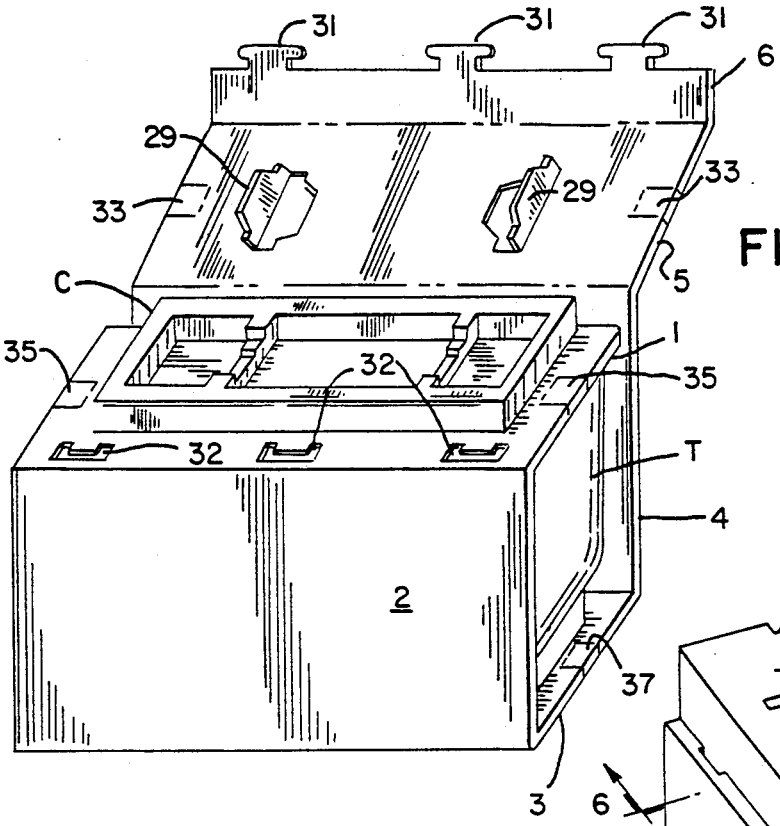
FIG. 4 is a perspective view of the blank of FIG. 1 folded around the article body, with the article cover in position on the separator panel with flaps of the top panel extended for centering and locating the article cover in position.

As shown in FIGS. 1–6, the container fits snugly around the article cover, body and support/riser pads. A blank consists of a body/cover separator panel 1, which is wider and longer than the article cover C, and which is located between the article cover C and the article body, tank T as shown. Separator panel 1 extends beyond the outer perimeter of the article cover C and is connected along a bend line 12 to the first side partial panel 2. Flaps 21 of panel 1 are folded downwardly along bend lines 22 into an upwardly facing cavity formed in article T. Flaps 23 of panel 1 are folded downwardly along bend lines 24 along the article body T outside surface to position and restrain the article body T within the shipping container. The partial first side panel 2 extends from blank edge to edge and downwardly across the first side of the article body T and terminates near the bottom edge of the article body T and body support/riser pads. Side panel 2 is connected along a bend line 13 to a bottom panel 3. The bottom panel 3 extends from blank edge to edge and across the article body T and body support/riser pads bottom and terminates at the bottom edge of the article body T and body support/riser pads second side. Bottom panel 3 is connected along a bend line 14 to a second side panel 4. Flaps 25 and 26 are folded upwardly along bend lines 27 and 28, respectively, to receive, hold and position article body support/riser pads 40 between the bottom of article body T and bottom panel 3, as best shown in FIG. 2.

The second side panel 4 which is opposite the first side panel 2 extends from blank edge to edge and upwardly across the article body support/riser pads 40, article body T and article cover C and terminates near the top edge of the article cover C second side and is connected along a bend line 15 to a top panel 5. The top panel 5 extends from blank edge to edge and across the article cover C and terminates near the top outer edge of the partial first side panel 2 bend line 12, and is connected along a bend line 16 to the top part of a partial first side panel 6. Flaps 29 are folded downwardly along bend lines 30 into an underside cavity formed in article cover C to position and restrain the article cover C within the shipping container.

The top partial first side panel 6 extends from blank edge to edge and downwardly across the first side of the article cover C and terminates near the top outer surface of the article body/cover separator panel 1. Locking tabs 31 provided on panel 6 bend downwardly for insertion into and through slots 32 formed in the top outer surface of panel 1. The ears of tabs 31 lock into position under and against the inner surface of panel 1 after being bent for insertion through slots 32, between article body T and the inner surface of first side panel 2.

Flaps 33 formed in top panel 5 fold downwardly along bend lines 34 and against article cover C. Flaps 35 formed in separator panel 1 fold downwardly along bend lines 36 and against the upper end area of article body T. Flaps 37 formed in bottom panel 3 fold upwardly along bend lines 38 and against article body support/riser pads 40. Flaps 33, 35 and 37 cooperate to receive steel or plastic banding 42, which may alternatively be cord or tape, for securing the shipping container, thereby restraining the article cover C and body T within the shipping container. This construction eliminates the need for shipping container ends.

Figure 7:
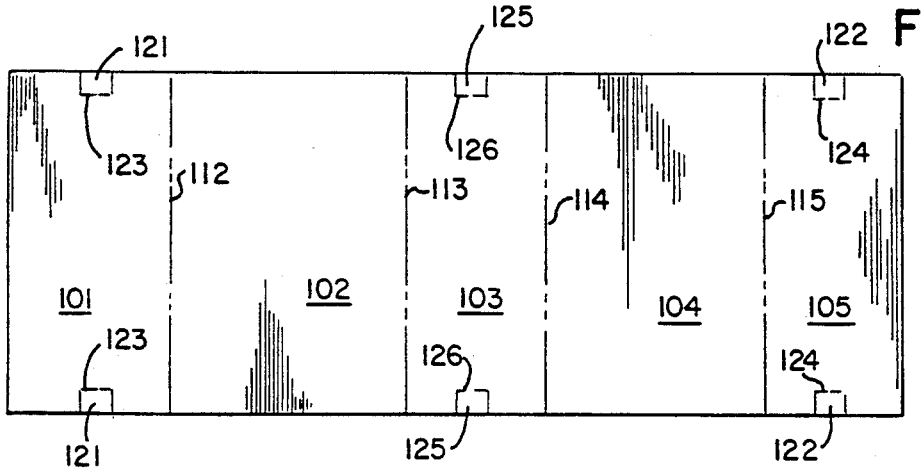
FIG. 7 is a top plan view of an unfolded alternate blank for forming a container according to the invention.
Figure 8:
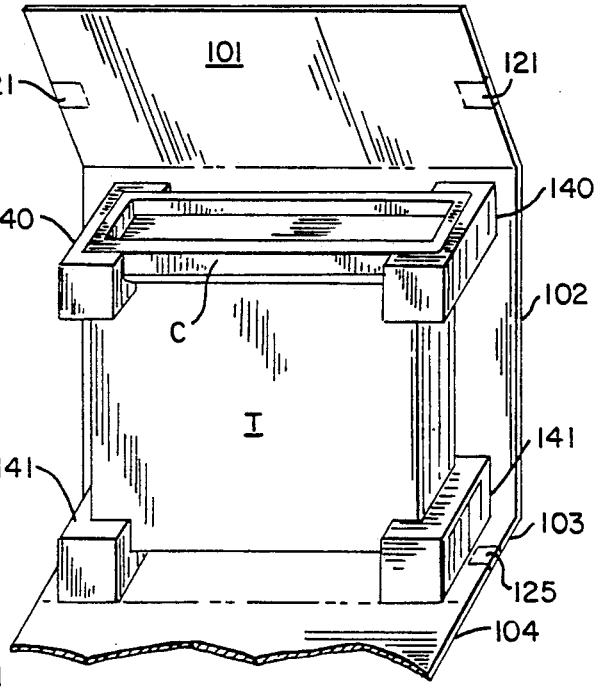
FIG. 8 is a partial perspective view of the partially folded blank of FIG. 7, showing use of two tray-end separator pads and two tray-end riser pads.
Figure 9:
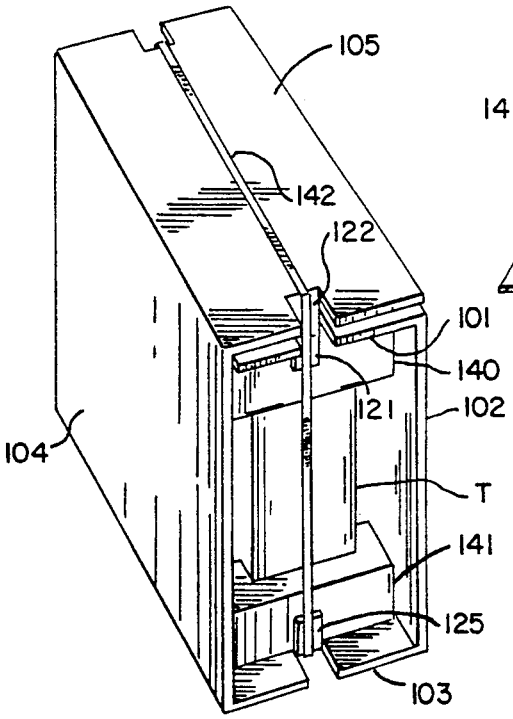
FIG. 9 is a perspective view of the blank and pads of FIGS. 7 and 8 folded around the article to provide an alternate shipping container of the present invention.

The embodiment of FIGS. 7 and 8 consists of a blank having five panels, right and left tray-end article cover/body separator pads 140 and right and left tray-end article body support/riser pads 141. Both the article cover/body separator pads 140 and the article body support/riser pads 141 are wider than the article cover C and body T and extend beyond the outer perimeter of the top, sides and ends of article cover C. The article and tray-end pads assembly is such that the body support/riser tray-end pads 141 are located on both ends of the article body bottom, the cover/body separator tray-end pads 140 are located on both ends of the article body top, and the article cover C is located within the cavity of the cover/body separator tray-end pads 140 as they lay on the article body top rim.

A blank (FIG. 7) contains a first top panel 101 which is as wide but longer than the article and pad assembly and extends beyond the pad ends and across the cover C and cover/body separator pads 140. Top panel 101 is connected along a bend line 112 to a first side panel 102. The first side panel 102 extends from blank edge to edge and downwardly across the article cover C, cover/body separator pads 140, article body T and body support riser pads 141, and terminates near the article body T and body support/riser pads 141 bottom edge. Side panel 102 is connected along a bend line 113 to a bottom panel 103. The bottom panel 103 extends from blank edge to edge and across the bottom of the article body T and body support/riser pads 141, and terminates at the second side of the article body T and body support/riser pads opposite side panel 102. Bottom panel 103 is connected along a bend line 114 to a second side panel 104. The second side panel 104, which is opposite the first side panel 102, extends from blank edge to edge and upwardly across the article body support/riser pads 141, article body T, article cover/body separator pads 140 and article cover C, and terminates near the top edge of the article cover C and cover/body separator pads 140. Side panel 104 is connected along a bend line 115 to a second top panel 105. The second top panel 105 extends from blank edge to edge and across and over the first top panel 101, terminating near the top outer edge of the first side panel 102.

Flaps 121 and 122 of panels 101 and 105, respectively, fold downwardly along bend lines 123 and 124, respectively, and against article cover/body separator pads 140. Flaps 125 of panel 103 fold upwardly along bend line 126 and against article body support/riser pads 141. Flaps 121, 122 and 125 cooperate to receive steel or plastic banding 142, which may alternatively be cord or tape, for securing the shipping container. This construction eliminates the need for shipping container ends.

Flaps 121, 122 and 125 in panels 101, 103 and 105 could be eliminated if gluing were the preferred method of closure. The article body support/riser pads 141 would be glued to panels 102, 103 and 104. The article cover/body separator pads 140 would be glued to panels 101, 102 and 104, and panels 101 and 105 would be glued together to complete the gluing operation. This construction would also eliminate the need for shipping container ends.

Figure 5:
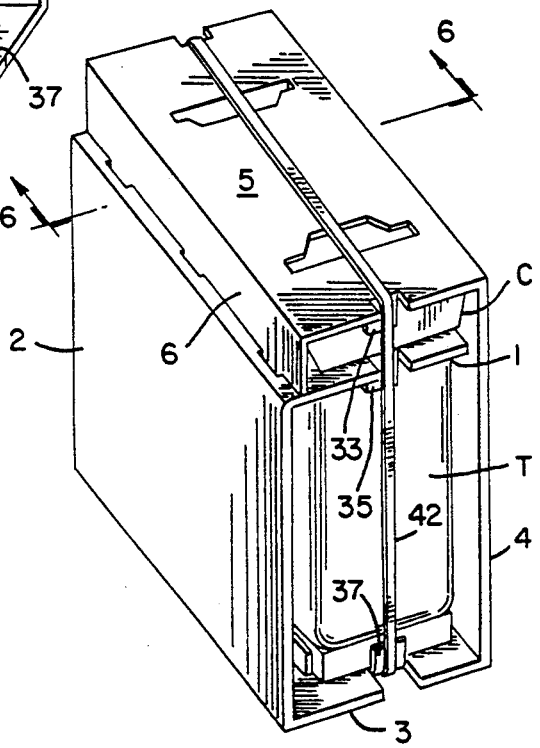
FIG. 5 is a perspective view of the blank and pads of FIGS. 1–4 folded around the article to provide a shipping container of the present invention.
Figure 6:
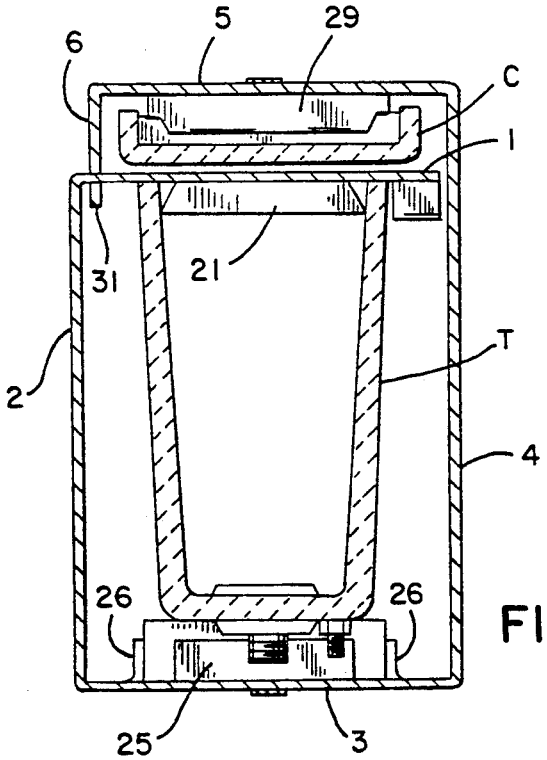
FIG. 6 is a cross-sectional view of the shipping container shown in FIG. 5.
Figure 11:
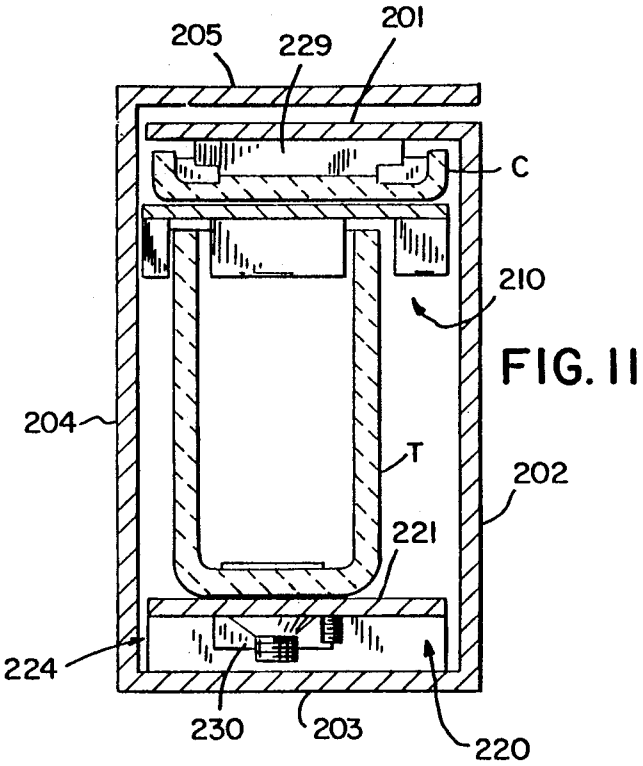
FIG. 11 is a cross-sectional view of an alternate shipping container of the present invention using a five panel outer wrapper and an article body riser pad assembly of FIGS. 12 and 13 and an article body/cover separator of FIG. 10.

The embodiment of FIG. 11 utilizes an arrangement similar to that shown in FIGS. 5 and 6. In the FIG. 11 embodiment, a first top panel 201 employs flaps 229 for engaging the cavity in the underside of cover C, similar to the construction of top panel 5 in FIGS. 5 and 6. A first side panel 202, a bottom panel 203, and a second side panel 204 enclose the sides and bottom of the article T and cover C. A second top panel 205 overlaps first top panel 201.

Figure 10:
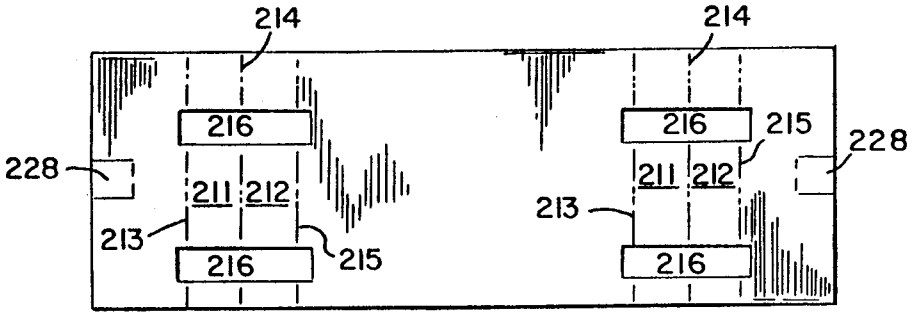
FIG. 10 is a top plan view of an unfolded blank which can be used as an alternate to form the article body/cover separator pads as shown in FIG. 8.

An article body/cover separator pad 210 is formed from the blank illustrated in FIG. 10. The blank includes panels 211 and 212 which are folded along bend lines 213, 214 and 215 to form V-shaped downwardly extending projections. A series of slots 216 accommodate placement of pad 210 on top of article T by receiving the upper ends of the walls of article T. Cover C is placed on top of pad 210.

Figure 12:
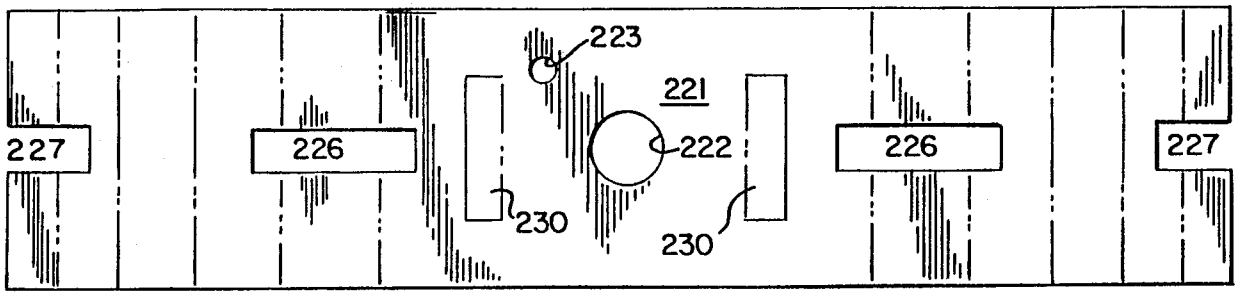
FIG. 12 is a top plan view of an unfolded blank which can be used as an alternate to form the article body riser pads shown in FIGS. 2 and 8.

An article support riser pad 220 (FIG. 13) is positioned between the bottom of article T and bottom panel 203, and is formed from the blank illustrated in FIG. 12. The bottom of article T is placed on a central panel 221, which is provided with an opening 222 to receive the drain pipe of article T, and an opening 223 to receive the filler pipe of article T. A series of end flaps are provided on either side of central panel 221, which are adapted to be folded 90° to each other to form end support members 224 and 225. Support members 224 and 225 space central panel 221 above panel 203 and provide clearance for the drain and filler pipes of article T. Flaps 230 are cut out of central panel 221 and engage the inner wall of support members 224, 225 to maintain members 224, 225 in a folded condition.

Slots 226 and 227 in the blank cooperate to define slots in support members 224 and 225 to receive banding or the like to secure the container of FIG. 11 together. Flaps 228 in article body/cover separator pad 210 also receive the banding or the like.

FIGS. 14 and 15 illustrate an alternate construction for the article support riser pads. In this embodiment, a panel 250 includes openings 251 and 252 to receive the drain and filler pipes, respectively, of article T. In all other respects, panel 250 is constructed the same as bottom panel 3 shown in FIGS. 1–6, so as to accept and position riser blocks 40 below panel 250. The riser pad of FIGS. 14 and 15 may be substituted for the riser pad of FIGS. 12 and 13 in constructing the shipping container shown in FIG. 11.

FIG. 16 illustrates an alternate embodiment for a shipping container, in which panels 1, 3 and 5 from the embodiment of FIGS. 1–6 are employed, with side panels 2, 4 and 6 and slots 32 removed.

In the embodiment of FIG. 16, each panel can be of the same or differing materials. The top panel 5 is located on and extends beyond the edges of the article cover C. The body/cover separator panel 1, which is similar in size to the top panel, is located between the article cover C and body T. The bottom panel 3, which is similar in size to the top and separator panels 5 and 1, provides the body riser pads 40 located under the article body T. This design lends itself to unitized load shipments for more efficient handling, material conservation, shipping and storage.

The container can be closed, sealed or secured, using any number of available means provided that the material is capable of withstanding the shipping and handling environment to which the container is subjected. Typical examples suitable for these containers include but are not restricted to: adhesives, banding (plastic or steel), plastic film or netting (stretch or shrink), staples, tape and combinations of either or all, etc. The closure method is dependent on the container design, material and the environment of handling, shipping and storage.

The shipping containers of FIGS. 6, 8, 11 and 16 can be made from many types of know folding board and packaging materials provided that the material is capable of withstanding the loads and environment to which the particular container is to be subjected. Typical examples suitable for these articles include but are not restricted to: fiber board, corrugated board (single or double face) made from fiber board or plastic sheeting, formable and foldable plastic foam sheeting, wood veneer and wire combination, etc. The selection of the material is determined by the design, fragility, weight and material of the article to be packed.

All the embodiments conserve packaging materials, labor and energy, and provide minimal material waste disposal. Also inherent in these packaging materials is that they are recyclable, which minimizes the need for more landfill sites.

The open-ended construction results in a minimum number of seams which must be secured in constructing the container. It also obviates the need for end walls and shipping spacers thereby minimizing packaging materials. The reduction in packaging materials also conserves material storage space both for container manufacturer and in the user's warehouse and production packaging areas.

Another important advantage of a shipping container of the invention is that any automatic packaging machinery can be designed more simply, thereby reducing the need for secondary material and energy requirements.

It will be apparent for those skilled in the science that various modifications of the preferred embodiments in addition to these mentioned above are possible without departing from the scope or spirit of the invention. For example, a secondary panel can be added to panel 1 of FIG. 1 so that there are two body/cover separator panels; or a separate body/cover separator panel (FIG. 10) made out of various types of material which may be the same or of differing materials from the blank wrapper; or the article cover can have its own wrapper; or the article body riser pad can be made as a one piece folder (FIGS. 12 and 13), or it can be an assembly (FIGS. 14 and 15), or it can consist of three individual (separate) panels and article body riser pads (FIG. 16), or it can consist of one top pad (FIG. 16), two body/cover separator pads and two body riser pads.

Each modification varies the article protective characteristics of the shipping container depending upon the article needs through its fragility, design, weight and materials. It may also be desirable to protect the enclosed articles from dust by placing them in transparent bags or wrappers. Therefore, the scope of the invention is not to be limited only to the descriptions of the preferred embodiments or articles mentioned above.

I claim:

1. An open-ended shipping container for an article and a cover for the article, comprising:

separating means placed between the article and the cover and extending across and beyond the outer edges of the article and the cover for spacing and supporting the article cover above the top of the article;

a top panel placed on top of the article cover and extending across and beyond the outer edges of the article cover;

a bottom panel placed below the article and extending across and beyond the outer edges of the article;

wherein the top and bottom panels and the separating means cooperate to define an open-ended container structure in which the ends of the article are exposed;

a pair of spaced lower supporting pads disposed between the article and the bottom panel which engage the bottom of the article at spaced locations to define a space between the bottom of the article and the bottom panel;

securing means for securing the article, article cover, the panels, the separating means and the supporting pads together to form an open-ended container for the article and article cover, comprising a strap wrapped about the article, article cover and panels; and flaps formed from portions of the top panel and the bottom panel, the flaps defining cut-out areas within which the strap is received, and wherein the flaps engage the separating means and the lower supporting pads.

2. An open-ended shipping container for an article and a cover for the article, comprising:

separating means placed between the article and the cover and extending across and beyond the outer edges of the article and the cover for spacing and supporting the article cover above the top of the article, comprising a pair of tray-end supports interposed between the article cover and the article for supporting and spacing the article cover above the article;

a top panel placed on top of the article cover and extending across and beyond the outer edges of the article cover;

a bottom panel placed below the article and extending across and beyond the outer edges of the article;

wherein the top and bottom panels and the tray-end supports cooperate to define an open-ended container structure in which the ends of the article are exposed;

a pair of spaced lower supporting pads disposed between the article and the bottom panel which engage the bottom of the article at spaced locations to define a space between the bottom of the article and the bottom panel; and securing means for securing the article, article cover, the panels, the tray-end supports and the supporting pads together to form an open-ended container for the article and article cover.

3. An open-ended shipping container for an article and a cover for the article, comprising:

separating means placed between the article and the cover and extending across and beyond the outer edges of the article and the cover for spacing and supporting the article cover above the top of the article;

a top panel placed on top of the article cover and extending across and beyond the outer edges of the article cover;

a bottom panel placed below the article and extending across and beyond the outer edges of the article;

wherein the top and bottom panels and the separating means cooperate to define an open-ended container structure in which the ends of the article are exposed;

a first side panel extending between and interconnecting the top and bottom panels, a second top panel, and a second side panel extending between and interconnecting the bottom panel and the second top panel, wherein the container bottom, side and first-mentioned top panels are wrapped about the article and article cover and the second top panel overlies the first-mentioned top panel;

a pair of spaced lower supporting pads disposed between the article and the bottom panel which engage the bottom of the article at spaced locations to define a space between the bottom of the article and the bottom panel;

securing means for securing the article, article cover, the panels, the separating means and the supporting pads together to form an open-ended container for the article and article cover.

* * * * *